United States Patent [19]

Duenisch et al.

[11] Patent Number: 4,672,268

[45] Date of Patent: Jun. 9, 1987

[54] GAS DISCHARGE LAMP WITH SINTERED CATHODE

[75] Inventors: Ingo Duenisch; Michael Lausch, both of Taunusstein, Fed. Rep. of Germany

[73] Assignee: Heimann GmbH, Weisbaden, Fed. Rep. of Germany

[21] Appl. No.: 815,921

[22] Filed: Jan. 3, 1986

[30] Foreign Application Priority Data

Feb. 22, 1985 [DE] Fed. Rep. of Germany ..... 3506296

[51] Int. Cl.[4] ..... H01J 61/06

[52] U.S. Cl. ..... 313/633; 313/632; 313/346 R

[58] Field of Search ..... 313/633, 632, 311, 346 R

[56] References Cited

U.S. PATENT DOCUMENTS

| | | | |
|---|---|---|---|
| Re. 26,855 | 4/1970 | Yasuda et al. | 313/633 X |
| 2,941,107 | 6/1960 | Nölle | 313/633 X |
| 4,303,848 | 12/1981 | Shimizu et al. | 313/633 X |
| 4,415,835 | 11/1983 | Mishra et al. | 313/633 X |

FOREIGN PATENT DOCUMENTS

| | | |
|---|---|---|
| 2935447 | 3/1980 | Fed. Rep. of Germany . |
| 3329270 | 2/1985 | Fed. Rep. of Germany . |

OTHER PUBLICATIONS

Japanese Patent Abstract, vol. 8, No. 81 (E-238) (1518) of Apr. 13, 1984.

*Primary Examiner*—Palmer C. DeMeo

*Attorney, Agent, or Firm*—Hill, Van Santen, Steadman & Simpson

[57] ABSTRACT

A gas discharge lamp such as a flashbulb consisting of an anode and a cathode in a transparent housing, the cathode being composed of a sintered member made up of powdered titanium (Ti), and vanadium (V), as well as at least one of the other metals tantalum (Ta) or niobium (Nb), the particles having a grain size of no more than 50 microns, and the Ti being present in a precentage of at least 40% by weight, and the V content being at least 10% by weight.

10 Claims, 1 Drawing Figure

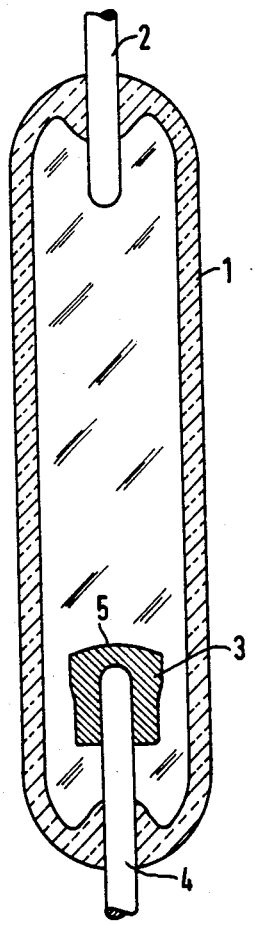
2
1
5
3
4

GAS DISCHARGE LAMP WITH SINTERED CATHODE

BACKGROUND OF THE INVENTION

1. Field of the Invention

The present invention is directed to a gas discharge lamp such as a flashbulb in which the cathode is a sintered powdered metal composite containing titanium, vanadium, and Ta and/or Nb.

2. Description of the Prior Art

Gas discharge lamps normally contain two electrodes in a gas-filled, light-permeable housing. The cathode is normally connected to a lead which is conducted through the housing in vacuum-tight fashion and the cathode is connected thereto.

It is also known to form the cathode as a porous sintered member. Salts of alkaline or alkaline earth metals are embedded into the pores of the sintered member. Any such sintered member should have a combination of characteristics to a greater or lesser degree. First, the porosity should be optimally high in order to provide the embedded salts with a large surface. The solidity should be high and, in particular, no particles should separate from the cathode during operation of the lamp. The ductility and shearing strength should be very high because the cathodes are usually secured to the power lead by mechanical affixation such as stamping or pressing during mass production, and are thereby greatly deformed. Next, the metals used should have a high melting point. Lastly, the metals used should have a high affinity for oxygen, hydrogen, carbon monoxide, and carbon dioxide, i.e., they should act as getters.

As will be appreciated, no single composition meets these requirements completely and a compromise has to be effected by choosing from a plurality of metal powders in making up the compact.

In JP-A-58/106761, there is disclosed a sintered cathode for flashbulbs composed of Ta, Nb, or alloys of the two.

In DE-A-33 29 270, there is a disclosure of a flashbulb wherein the cathode is a sintered member composed of the metals W, Mo, Ti, Ni, Ta and Nb.

In DE-A-29 35 447, there is described a sintered electrode for flashbulbs composed of a basic metal (W,Mo,Ta or a mixture of these metals) and of an alkali earth metal or earth metal compound. A metal oxide of yttrium, zirconium, aluminum, or mixtures thereof is also present in the sintered member.

SUMMARY OF THE INVENTION

The present invention provides a gas discharge lamp of the type described having an improved cathode member which provides an optimum compromise for the requirements of a cathode listed above.

In accordance with the present invention, the cathode member is a sintered member containing the metals Ti and V as well as one or both of the metals Ta or Nb. The powdered metal making up the sintered compact has a grain size no greater than 50 microns. The Ti is present in a weight percentage of at least 40% and the V in the weight percentage of at least 10%.

BRIEF DESCRIPTION OF THE DRAWING

The single FIGURE of the drawing illustrates a cross-sectional view of an improved gas discharge lamp produced according to the present invention.

DESCRIPTION OF THE PREFERRED EMBODIMENTS

In the flashbulb shown in the drawing, there is provided a transparent housing 1 composed of quartz, hard glass or the like. Inside the housing 1 there is positioned an anode 2 and a cathode 3. The cathode is secured to a lead 4 by pressing or the like, and the lead extends through the housing 1 in vacuum-tight relationship. The cathode 3 has an upper surface 5 facing the anode 2.

The cathode 3 is a sintered composite containing a mixture of metal powders. The mixture of powders is composed of at least three of the four pure metal powders Ti, Ta, Nb and V each having a grain size of 50 microns or less. The percentage of Ti is at least 40% by weight, and that of V at least 10% by weight.

When the mixture consists of the three elements Ti, V and Ta, the preferred composition contains 50 to 60 weight percent Ti, from 10 to 30% V, and the balance essentially Ta except for the usual incidental impurities.

When the cathode consists of a three element mixture of Ti, V, and Nb, the preferred composition contains 40 to 50% by weight Ti, from 10 to 30% V, and the balance essentially Nb except for incidental impurities.

In the case of a four component mixture, the preferred ranges are 40 to 50 weight percent Ti, from 10 to 30 weight percent V, about 10% Ta, and the balance essentially Nb, except for incidental impurities.

In particular, the following mixtures were found to be effective by means of successful tests in a gas discharge tube:

| | | | | |
|---|---|---|---|---|
| 1. | Ti | Ta | V | |
| | 50 | 20 | 30 | |
| | 50 | 30 | 20 | |
| | 60 | 30 | 10 | |
| | 60 | 20 | 20 | |
| 2. | Ti | Nb | V | |
| | 40 | 30 | 30 | |
| | 40 | 40 | 20 | |
| | 50 | 40 | 10 | |
| 3. | Ti | Ta | Nb | V |
| | 40 | 10 | 20 | 30 |
| | 50 | 10 | 30 | 10 |
| | 50 | 10 | 20 | 20 |

The compositions listed above represent a good compromise between porosity, solidity and ductility. Furthermore, all four ingredients are metals which have high melting points and good getter properties. Flashbulbs prepared with the foregoing mixtures have many distinct advantages. For one, they possess approximately a 15% higher light yield in comparison to Ni base cathodes. They evidence 10% less blackening after the required service life. They have a specific loadability 20% higher than the normal nickel base cathodes. They have been found to provide 80% fewer failures due to cathode particles broken off, and optical defects. They also evidence a reduction of the so-called "noise", i.e., high frequency disturbance at the beginning of ionization.

It should be evident that various modifications can be made to the described embodiments without departing from the scope of the present invention.

We claim as our invention:

1. A gas discharge lamp comprising:

a gas-filled, light-permeable housing, an anode in said housing and a cathode in said housing spaced from said anode, said cathode being a sintered mixture of metal powders having a grain size of not more than 50 microns, said metal powders including Ti and V, and at least one of the metals Ta and Nb, said mixture containing at least 40% by weight Ti and at least 10% by weight V.

2. A gas discharge lamp according to claim 1:
wherein said mixture contains from 50 to 60% Ti, from 10 to 30% V, and the balance essentially Ta.

3. A gas discharge lamp according to claim 1:
wherein said mixture contains from 40 to 50% Ti, from 10 to 30% V, and the balance essentially Nb.

4. A gas discharge lamp according to claim 1:
wherein said mixture contains from 40 to 50% Ti, from 10 to 30% V, about 10% Ta, and the balance essentially Nb.

5. A gas discharge lamp according to claim 1:

wherein said mixture contains about 50% Ti, about 20% Ta, and about 30% V.

6. A gas discharge lamp according to claim 1:
wherein said mixture contains about 50% Ti, about 30% Ta, and about 20% V.

7. A gas discharge lamp according to claim 1:
wherein said mixture contains about 40% Ti, about 30% Nb, and about 30% V.

8. A gas discharge lamp according to claim 1:
wherein said mixture contains about 40% Ti, about 40% Nb, and about 20% V.

9. A gas discharge lamp according to claim 1:
wherein said mixture contains about 40% Ti, about 10% Ta, about 20% Nb, and about 30% V.

10. A gas discharge lamp according to claim 1:
wherein said mixture contains about 50% Ti, about 10% Ta, about 30% Nb, and about 10% V.

* * * * *